US006080976A

United States Patent [19]

Nara

[11] Patent Number: 6,080,976

[45] Date of Patent: Jun. 27, 2000

[54] HEATING APPARATUS UTILIZING MICROWAVES

[75] Inventor: Akikazu Nara, Kyoto, Japan

[73] Assignee: Naraseiki Kabushiki Kaisha, Kyoto, Japan

[21] Appl. No.: 08/189,833

[22] Filed: Feb. 1, 1994

[30] Foreign Application Priority Data

Feb. 2, 1993 [JP] Japan ..... 5-015121

[51] Int. Cl.[7] ..... H05B 6/80

[52] U.S. Cl. ..... 219/687; 219/759

[58] Field of Search ..... 219/687, 730, 219/759, 757

[56] References Cited

U.S. PATENT DOCUMENTS

| | | | |
|---|---|---|---|
| 2,188,625 | 1/1940 | Dufour et al. | 219/291 |
| 3,083,528 | 4/1963 | Brown | 219/759 |
| 3,691,421 | 9/1972 | Decker et al. | 428/372 |
| 4,310,738 | 1/1982 | Moretti et al. | 219/688 |
| 4,822,966 | 4/1989 | Matsubara | 219/759 |
| 4,899,032 | 2/1990 | Schwarzl et al. | 219/375 |
| 4,959,516 | 9/1990 | Tighe et al. | 219/730 |
| 5,136,143 | 8/1992 | Kutner et al. | 219/544 |
| 5,187,349 | 2/1993 | Curhan et al. | 219/202 |
| 5,254,822 | 10/1993 | Nara | 219/10 |

FOREIGN PATENT DOCUMENTS

| | | |
|---|---|---|
| 4298623 | 10/1992 | Japan . |
| 4301122 | 10/1992 | Japan . |
| 2231762 | 11/1990 | United Kingdom . |

OTHER PUBLICATIONS

WIPO Abstract WO 93/00781, Breccia Fratadocchi, "A Microwave Heating Method and a . . . Heating Device", Jan. 7, 1993.

*Primary Examiner*—Philip H. Leung
*Attorney, Agent, or Firm*—Leydig, Voit & Mayer

[57] ABSTRACT

A heating apparatus utilizing microwaves characterized in that it is possible to heat with a super high temperature over about 1000° C. and also to control the temperature within the wide range from such a super high temperature to a comparative low temperature. The heating apparatus is composed of a heating element mainly made of a carbon powder and sintered in honeycomb structure, a microwave generator irradiating microwaves to the heating element and an air blower blowing air to the heating element thereby obtaining hot air with high temperature.

3 Claims, 2 Drawing Sheets

HEATING APPARATUS UTILIZING MICROWAVES

BACKGROUND OF THE INVENTION

The present invention relates to a heating apparatus utilizing microwaves which is especially suitable for generating hot air, for re-burning and purifying substances such as exhaust gas, for burning an inflammable thing and for heating objects to be heated.

Hitherto, there has been widely known a hot air electric heater with nichrome wire or a gas hot air heater using gas, etc. as a heating apparatus generating hot air.

Those hot air electric heater and gas hot air heater, however, could not easily heat to a temperature as high as 1000° C. or over.

Further, there have been some apparatus for burning an object to be burned utilizing microwaves such as JP-A-4-301122 and JP-A-4-298623, etc. which mainly consist of filters, ceramics of honeycomb structure, a microwave generator and a waveguide. These apparatus are used to burn the particulates (very minute particles) included in the exhaust gas which are generated by internal combustion engines. The particulates are caught by the filter and are burned with microwaves. The filter and the honeycomb structured ceramics including the microwave absorption materials are heated by being irradiated with microwaves but not to a temperature in the vicinity of 1000° C. because the usual microwave absorption materials are not stable at to such a high temperature.

The object of these apparatus is to burn the particulates (very minute parts) of the exhaust gas, which are caught by the filter, directly with microwaves. The remains or the exhaust gas not caught by the filter will be exhausted without being purified and even the particulates caught by the filter may not be burned completely because the filter is not heated to such a high temperature as 1000° C. or over.

SUMMARY OF THE INVENTION

The present invention can heat to a temperature as high as 1000° C. or over and the object of the present invention is to provide a heating apparatus which can control the temperature within a wide range or from a very high temperature (about 2000° C.) to a relatively low temperature (about 30° C.).

A heating element of the present invention absorbing microwaves heats to a high temperature by being irradiated with microwaves and can heat the object to be heated to high temperature in a matter somewhat related to that described in U.S. Pat. No. 5,254,822, incorporated herein by reference.

Being formed in a honeycomb structure, the heating element obtains high efficiency of heat exchange. Further it is possible to control the temperature in a wide range of from high temperature to low temperature by controlling the output of an electromagnetic microwave generator.

The heating, element which is mainly made of carbon powder, heats to a high temperature by being irradiated with a microwave and heats the gas, for example, such as air or exhaust gas, etc. to the high temperature. The gas, etc. passes through the heating element contacting its surface very closely and is heated to a high temperature with high efficiency of heat exchange due to the honeycomb structure of the heating element.

DESCRIPTION OF THE PREFERRED EMBODIMENT

One embodiment of the present invention will be explained with reference to the attached drawings hereinafter.

Figure 1:
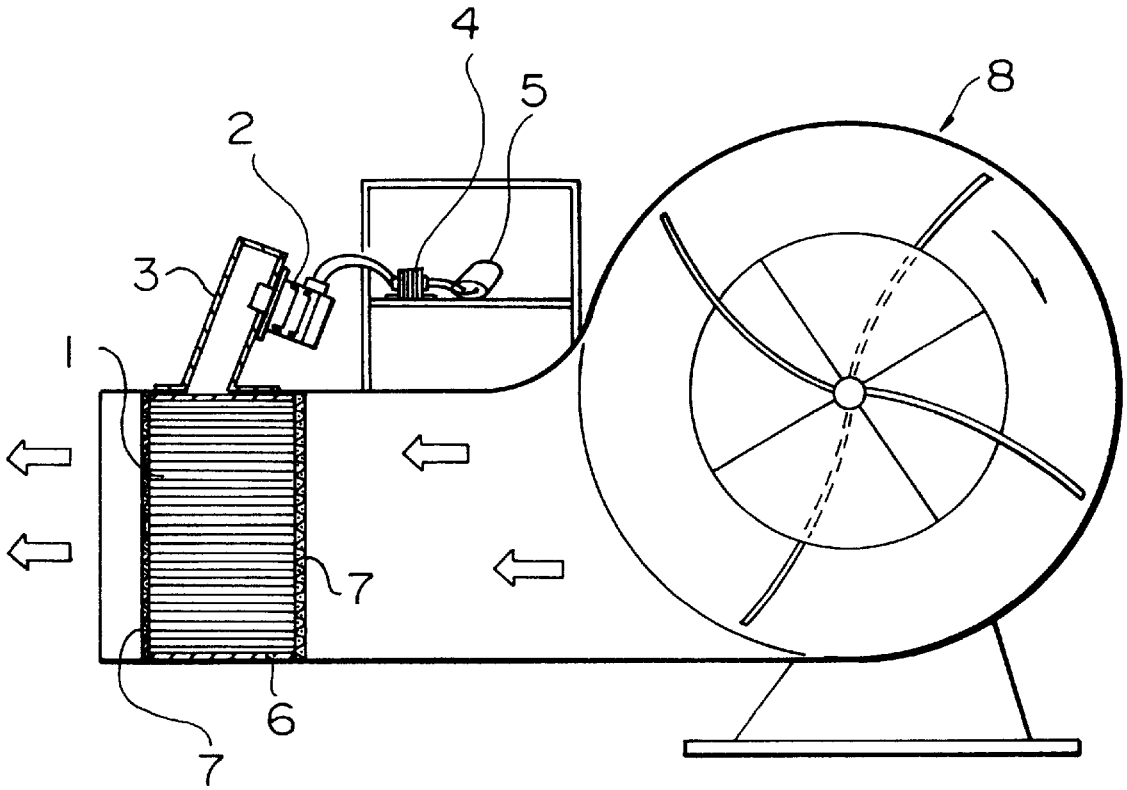
FIG. 1 is a schematic side sectional view showing a very high temperature heating apparatus of one embodiment of the present invention.
Figure 2:
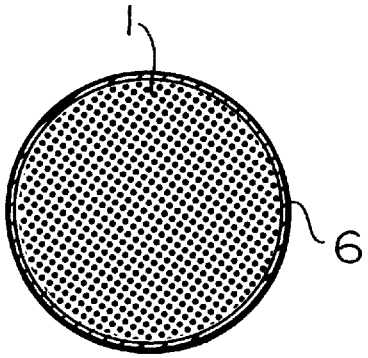
FIG. 2 is a front view showing a heating element with a honeycomb structure in FIG. 1.

FIG. 1 shows a very high temperature heating apparatus of one embodiment of the present invention. A heating element with a honeycomb structure 1 shown in FIGS. 1 and 2 generates high temperature by being irradiated through a waveguide 3 with microwaves generated by a magnetron 2 which generates microwaves of 2450 MHz.

The heating element with honeycomb structure 1 is mainly made of a carbon powder in which an alumina powder can be mixed.

If microwaves having a high frequency of about 2450 MHz, ordinarily used for an electronic range or the like are used to irradiate the heating element 1, the carbon powder is mainly heated due to a dielectric heating function to reach a high temperature. By adjusting a mixture ratio of the carbon powder and the alumina powder, it is possible to adjust the generated temperature within a range from about 30° C. to about 2000° C. As mentioned above, the temperature of the heating element is changed in accordance with the mixture ratio, and the following table lists the experimental results showing the relationship between the lapse time in which the mixture with about 3 gr, is heated to the temperature within the range from about 600° C. to about 700° C. and the mixture ratio (volume ratio).

TABLE 1

The Lapse Time in which the mixture with about 3 gr is heated to the temperature within the range of from about 600° C. to about 700° C.

| | 1 min. | 1 min. 10 sec. | 1 min. 30 sec. | 2 min. | 600° C.–700° C. 2 min. |
|---|---|---|---|---|---|
| Carbon | 2 | 1.5 | 1.2 | 1 | 0.3 |
| Alumina | 0 | 0.5 | 0.8 | 1 | 1.5 |

As is apparent from the above table, if there is no alumina powder, the heating element reaches to the above high temperature 600° C. to about 700° C. in only one minute, but as the alumina powder is increased, the time required to reach the predetermined temperature is also increased. This means that the alumina powder functions to restrict an abrupt increment of temperature of the heating element and to retain the high temperature of the heating element. Furthermore, if the amount of the alumina powder is increased rather than the amount of the carbon powder, not only is there obtained a longer elapsed time to reach the specified temperature but also the highest temperature attained may be restricted to about 400° C. to 500° C.

The heating element with a honeycomb structure 1 can be made by a sinter forging process using moulding blocks under high temperature and high pressure and has many beehive-like small penetrating holes in the inside. It is possible to make the heating element with a honeycomb structure of about 100 mm in diameter with many penetrating holes, of which one is about 1 mm in diameter by about 20 mm long.

The section of a penetrating hole can be formed in any cross-sectional shape such as a circle, a logenze, a rectangle, a hexagon, a triangle, etc.

The magnetron 2 is supplied with electric power from sources of electricity using a transformer 4 and a condenser 5. The heating element with a honeycomb structure 1 is covered with an adiabatic material 6 on its outside. An air blower 8 blows the wind into the heating element 1. A mesh filter 7 to prevent the leakage of microwaves is equipped in front of and at the back of the heating element with a honeycomb structure 1. Microwaves generated by a magnetron 2 irradiate the heating element with honeycomb structure 1 from the outside to the center. The air heated by the heating element with the honeycomb structure 1 is heated to maximum of about 2000° C.

Accordingly a very high temperature heating apparatus generating the hot air of such a high temperature as above-mentioned can be used for a fan-heater, a drier, a desiccator, an exhaust gas purifying apparatus, an oil cleaner, a separator of water and oil, a combustion furnace, etc.

The temperature of the heating element 1 can be controlled by adjusting the volume of irradiation of microwaves generated by the magnetron 2.

Figure 3:
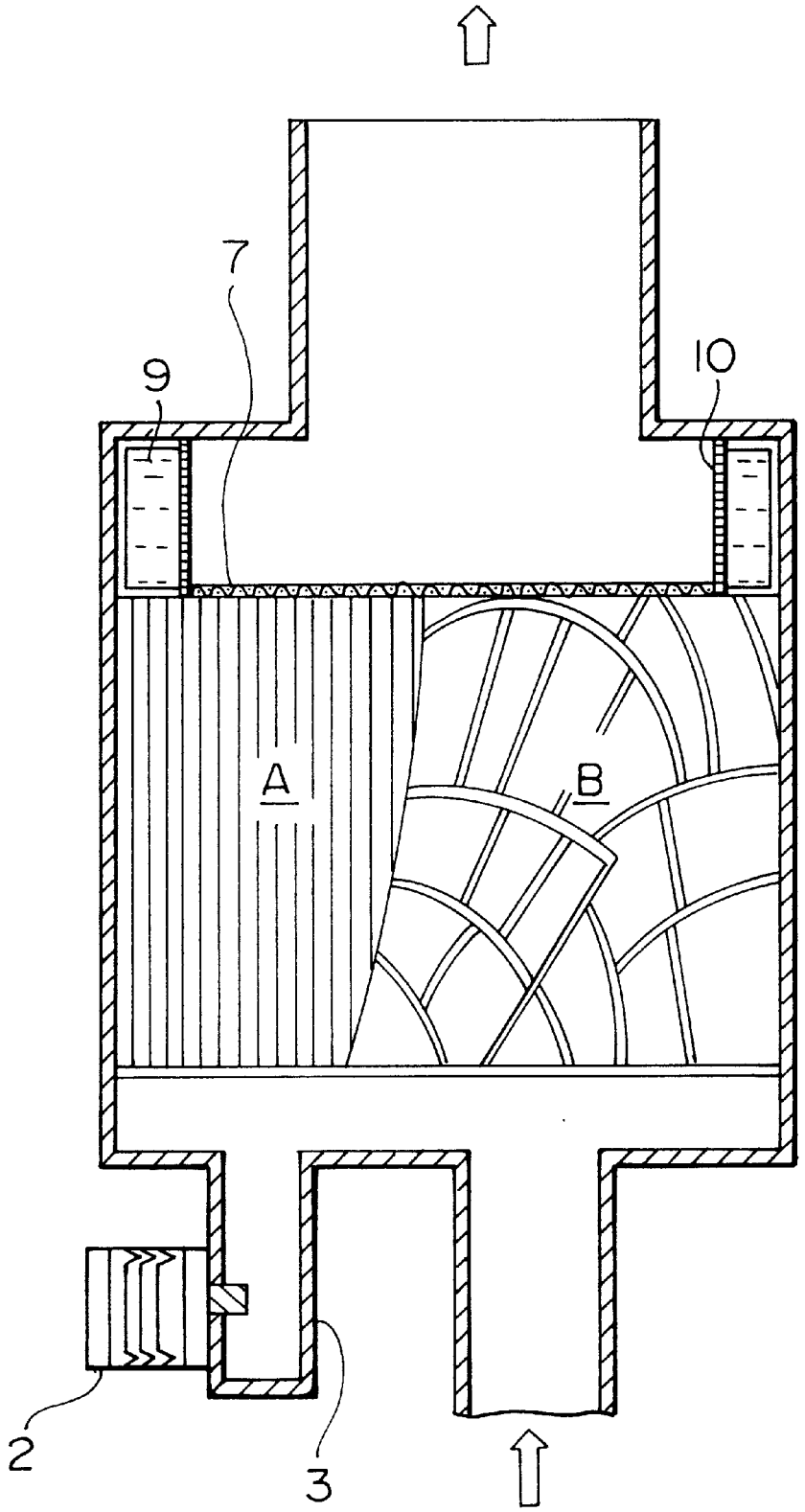
FIG. 3 is a schematic side sectional view showing an exhaust gas purifying apparatus.

FIG. 3 shows an exhaust gas purifying apparatus which is another embodiment of the present invention. For example, exhaust gas generated from an internal combustion engine comes from the bottom, passes through the cylindrical exhaust gas purifying apparatus and goes out the upper part. There is packed a heating element A or a heating element B in the inside of the exhaust gas purifying apparatus.

As mentioned in the first embodiment, a microwave generated by the magnetron 2 is irradiated through a waveguide 3 to a heating element A or B which is heated to about 1350° C. The heating element A is similar to the heating element with honeycomb structure above-mentioned and has many straight penetrating holes. Exhaust gas moves straight through penetrating holes of the heating element A. The heating element B has many winding holes or tortuous channels. This offers the increasing high efficiency in combusting or decomposing inflammable constituents and purifying the exhaust gas because the exhaust gas stays in the holes longer and is heated longer due to winding holes. The exhaust gas is heated to a high temperature by contacting with the heating element A or B of high temperature and as a result, an inflammable constituent of the exhaust gas burns and a nitrogen oxide and a stink constituent, etc. are eliminated. There is equipped a mesh filter 7 to prevent the leakage of microwaves on the heating element.

Water 9 is supplied automatically from a water supply device (not shown) which is set above the exhaust gas purifying apparatus. Vapor jets from minute holes of the mesh 10 and mingles with the exhaust gas. Such a mixture is utilized to eliminate nitrogen oxides.

While the exhaust gas goes through the heating element A or B, an inflammable constituent of the exhaust gas burns, and a stink, etc. can be eliminated. Materials to prevent a thermal oxidation can be coated on the surface of the heating element 1. That is to say, the heating element 1 is coated on the surface with the mixed solution which contains fine or minute powders of metal oxide or other heat-resistant materials and then is dried to evaporate a solvent of the mixed solution. And accordingly materials to prevent a thermal oxidation cover the surface of the heating element 1. The covering with a thickness of about 20 microns or more is the most ideal for the materials to prevent a thermal oxidation. There are zirconium, aluminium, silica, nitriding aluminium, etc. as a metal oxide and heat-resistance temperatures of these materials are 2600° C., 2050° C., 1760° C. and 2700° C.–2800° C. respectively.

One of the means to prevent an oxidation of a carbon or of a mixture of a carbon and alumina is to mix a silicon carbide powder with a carbon powder or an alumina powder. If carbon powders are oxidized, they will be covered with oxide membranes. As a result, a combination of carbon powders themselves or a combination of carbon powders and alumina powders will become less effective. It also causes a honeycomb structure sintered under a high temperature and a high pressure to be easily deformed. To prevent such an oxidation, it is effective to mix a silicon carbide powder with a carbon powder or with a mixture of a carbon powder and an alumina powder. Furthermore, as explained in the example of the alumina powder above-mentioned, it is possible to get a more gradual and stable increase in temperature.

The following table contains experimental results showing the relationship between the lapse time in which the mixture is heated to the temperature within the range from about 600° C. to 700° C. and the mixture ratio (volume ratio) of the carbon powder, the alumina powder and the silicon carbide powder.

TABLE 2

The Lapse Time in which the mixture is heated to the temperature within the range of from about 600° C. to about 700° C.

| | 1 min. | 1 min. 10 sec. | 1 min. 30 sec. | 2 min. | 600° C.–700° C. 2 min. 30 sec. |
|---|---|---|---|---|---|
| Silicon Carbide | 2 | 1.5 | 1.2 | 1 | 0.5 |
| Alumina | 0 | 0.5 | 0.8 | 1 | 1.5 |
| Carbon | 1.5 | 1 | 0.7 | 0.5 | 0.3 |

As mentioned above, according to the present invention, high temperature is easily and quickly obtained by utilizing a heating element with high temperature generated very efficiently due to the irradiation of microwaves. Therefore, not only a hot air for the heater or the dryer but also a hot blast with high temperature for the combustion of the inflammable materials is easily obtained. Further it is possible to decompose inflammable constituents and purify the exhaust gas quickly. It is possible to dry and burn garbage discharged from, for example, restaurants, hospitals and the home, etc. and to destroy by fire bubbled polystyrenes, etc.

The heating element of the present invention can be used with microwaves in the wide applications as the supply source of the heating for a refrigerator or a cooling apparatus, a fan heater for heating rooms, a washing and drying machine, a separator of water and oil, a water heating apparatus, a solution heating apparatus, a sterilizer, a cooking apparatus, etc. because it is possible to control the temperature in the wide range of from high temperature (about 2000° C.) to low temperature (tens of degrees in Celcius).

What is claimed is:

1. A heating apparatus using microwaves comprising:

(a) a heating element for heating a fluid passing therethrough and mainly made of carbon powder, alumina powder, and silicon carbide powder in proportions preselected to provide an operating temperature in the range of about 30° C. to about 2,000° C., sintered in a honeycomb structure, and having a surface covered with membranes to prevent thermal oxidation, (b) a microwave generator for irradiating said heating element with microwaves, and (c) an air blower for blowing air to the said heating element.

2. A heating apparatus utilizing microwaves comprising:

(a) a heating element for combusting flammable materials passing therethrough and mainly made of carbon powder, alumina powder, and silicon carbide powder in proportions preselected to provide an operating temperature in the range of about 30° C. to about 2,000° C., sintered in a honeycomb structure, and having a surface covered with membranes to prevent thermal oxidation, (b) a microwave generator for irradiating said heating element with microwaves, and (c) a conduit in fluid communication with said heating element to supply an inflammable material-containing fluid to said heating element.

3. A heating apparatus utilizing microwaves comprising:

(a) a heating element for combusting flammable materials passing therethrough and mainly made of carbon powder, alumina powder, and silicon carbide powder in proportions preselected to provide an operating temperature in the range of about 30° C. to about 2,000° C. sintered in a honeycomb structure, (b) a microwave generator for irradiating said heating element with microwaves, (c) a conduit in fluid communication with said heating element to supply an inflammable material-containing fluid to said heating element, and (d) means to introduce jets of water to exhaust gas which emanates from said heating element.

* * * * *